US006401512B1

(12) United States Patent
Gascoin

(10) Patent No.: US 6,401,512 B1
(45) Date of Patent: Jun. 11, 2002

(54) PRESS BRAKE WITH ACTIVE LOWER TABLE

(75) Inventor: Claude Gascoin, Laigne en Belin (FR)

(73) Assignee: Amada Europe, Tremblay en France (FR)

( * ) Notice: Subject to any disclaimer, the term of this patent is extended or adjusted under 35 U.S.C. 154(b) by 0 days.

(21) Appl. No.: 09/763,626

(22) PCT Filed: Sep. 8, 1999

(86) PCT No.: PCT/FR99/02131

§ 371 (c)(1),
(2), (4) Date: Mar. 6, 2001

(87) PCT Pub. No.: WO00/13813

PCT Pub. Date: Mar. 16, 2000

(30) Foreign Application Priority Data

Sep. 9, 1998 (FR) ..... 98 11240

(51) Int. Cl.[7] ..... B21D 5/02
(52) U.S. Cl. ..... 72/389.5; 72/389.4
(58) Field of Search ..... 72/389.4, 389.5, 72/389.3

(56) References Cited

U.S. PATENT DOCUMENTS

| | | | | |
|---|---|---|---|---|
| 3,914,975 A | | 10/1975 | Kawano | |
| 4,016,742 A | * | 4/1977 | Shiokawa | 72/389.5 |
| 4,580,434 A | * | 4/1986 | Graf | 72/389.5 |
| 5,293,972 A | * | 3/1994 | Krumholz | 72/389.5 |

FOREIGN PATENT DOCUMENTS

| | | | |
|---|---|---|---|
| DE | 2317832 | | 10/1974 |
| EP | 0543772 | | 5/1993 |
| JP | 59-193718 | * | 11/1984 |
| JP | 6-55218 | * | 3/1994 |
| JP | 2558928 | * | 9/1997 |
| JP | 2000-343125 | * | 12/2000 |
| JP | 2001-121214 | * | 5/2001 |

OTHER PUBLICATIONS

English language translation of Claim 1 (as partial translation) of Japanese document HEI 2–558928 Y.
English language translation of Claim 1 (as partial translation) of German document DE 2 317 832.

* cited by examiner

*Primary Examiner*—David Jones
(74) *Attorney, Agent, or Firm*—Greenblum & Bernstein, P.L.C.

(57) ABSTRACT

A bending press for bending metal sheets, the press comprising a moving top panel and a fixed bottom panel, the bottom panel being constituted by a plate having a top portion and a fixed bottom portion defined by two notches that are symmetrically identical about the transverse mid-plane of the bottom panel, each notch having a top wall and a bottom wall interconnected by a back wall, and also having an opening situated in the corresponding side edge of the plate, the press being characterized in that each notch is fitted with a displacement member interconnecting the free top portion and the fixed bottom portion of the bottom panel so as to cause the top wall of the notch to move towards the bottom wall thereof, thereby modifying the deformation curve of the free top portion of the bottom panel in controlled manner.

16 Claims, 2 Drawing Sheets

PRESS BRAKE WITH ACTIVE LOWER TABLE

The present invention relates to a bending press for bending metal sheet, the press being of the type comprising a top panel placed above a bottom panel, the bottom panel being fixed and supported at its ends while the top panel is movable and actuated in a vertical plane by drive members likewise situated at its two ends.

The drive members deliver the force required for bending metal sheets or laminations and these give rise to oppositely-directed deformation of the two panels.

With that type of structure, under the action of the bending forces, the longitudinal deformation curves of the panels (each curve being in the form of a single arc) are substantially symmetrical about the separation plane of the panels such that the maximum separation between the panels occurs in the vicinity of the midpoint between the thrust points (drive members and fixed supports) and represents twice the maximum deformation of each panel.

The maximum separation between the top and bottom panels is an essential parameter concerning the precision and the quality of the bending performed, and in the above-mentioned case, since the two panels are separated to a greater extent in the middle than at the ends, the bending will be more open in the center than at the ends.

To mitigate that drawback, a solution is proposed in Japanese utility model No. 2 558 928 which describes a bending press comprising a moving top panel and a fixed bottom panel constituted by a plate of uniform thickness having two notches made therein that are symmetrically identical about the transverse midplane of said bottom panel.

Each notch has a top wall and a bottom wall that are interconnected by a back wall and also has an opening situated in the corresponding side edge of the plate.

The plate thus has a bottom portion and a top portion situated respectively below and above the notches. Advantageously, the bottom portion of the plate is fixed to two cheek plates that also support the top panel, while the top portion of the plate, or more exactly its ends, are free to move in a vertical plane.

Under such conditions, under the action of bending forces, longitudinal deformation curves are obtained for the two working edges of the top and bottom panels that are as parallel as possible, and therefore as close together as possible.

That Japanese utility model also states that each of the notches is provided with a moving member whose position can be adjusted manually or automatically within the notches. The moving member comes directly into contact with the bottom and top walls of each notch and moving the moving member makes it possible to reduce the equivalent depth of said notches, thereby reducing the elasticity of the bottom panel as the moving member is moved closer to the open ends.

Unfortunately, the use of that type of bending press does not make it possible to ensure that the deformation curves of the facing edges of the bottom and top panels are accurately parallel.

The pressure exerted on the free top portion of the bottom panel is a function only of the force applied by the work of the drive members on the top panel, and consequently by the sheet metal to be folded, and nothing in those conditions makes it possible to take voluntary action on said pressures and thus on the deformation to which said top portion of the bottom panel is subjected in order to cause it to deform accurately parallel to the deformation to which the top panel is subjected.

Furthermore, when the moving member lies substantially level with the back wall of the notch and the force applied by the work of the members is large, the deformation curve of the bottom panel is then at its maximum, in which case the intrinsic elasticity of the top portion of the bottom panel can be irremediably harmed.

An object of the present invention is to overcome the above-mentioned technical problems in satisfactory manner.

The invention achieves this object by means of a bending press for bending sheet metal, the press being of the type comprising a top panel disposed above a bottom panel, the bottom panel being fixed and supported at its ends while the top panel is moving and actuated in a vertical plane by drive members situated likewise at its ends, the bottom panel being constituted by a plate having a free top portion and a fixed bottom portion defined by two notches that are symmetrically identical to the transverse midplane of said bottom panel, each notch having a top wall and a bottom wall interconnected by a back wall, and also having an opening situated in the corresponding side edge of the plate, the press being characterized in that each notch is fitted with a displacement member interconnecting the free top portion and the fixed bottom portion of the bottom panel so as to cause the top wall of the notch to move towards the bottom wall thereof, thereby modifying the deformation curve of the free top portion of said bottom panel in controlled manner.

According to another feature, each displacement member comprises firstly a fixed portion connected to the bottom wall of the notch and secondly a moving portion secured to the top wall of the notch.

According to another feature, each displacement member is situated in the opening of its notch, so as to enable the free ends of the top walls of said notches to be moved accurately.

According to another feature, the bending press includes a control unit for independently controlling each displacement member as a function of the curve to be given to each end of the free top portion of the bottom panel.

According to another feature which is advantageous, the control unit comprises:

means for receiving curve information concerning the curve to be given to the free top portion of the bottom panel; and means for converting said curve information into control information for the displacement members.

According to yet another feature which is advantageous, the control unit further comprises measurement means for obtaining information about the actual curve of free top portion of the bottom panel, and the programmed curve.

Thus, the displacement member of the invention makes it possible to monitor and adjust in reliable manner the deformation curve of the free top proton of the bottom panel, and to do so without running the risk of exceeding the elastic limit of said bottom panel.

Furthermore, given that the deformation curve of the bottom panel is no longer a function of the force applied by the work of the drive members on the top panel, it will be understood that merely by performing strength and structure calculations concerning the top panel and the sheet metal to be bent, the displacement member can be adjusted accurately so that the extent to which the top wall of the notch moves towards the bottom wall is adjusted accurately, thereby making it possible to obtain deformation curves for the bottom and top panels that are accurately parallel.

The invention will be better understood on reading the following description accompanied by the drawings, in which:

FIGS. 1 and 2 show a bending press of the invention.

This bending press comprises a top panel 1 and a bottom panel 2 that are mounted in a frame made up of two end plates 9*a* and 9*b* united by a crossbrace beam (not shown).

The top and bottom panels 1 and 2 lie in a common vertical plane and the top panel slides relative to the end plates 9*a* and 9*b* with the help of guide means 8*a* and 8*b* constituted, for example, by two hydraulic actuators.

The working edges of the top and bottom panels carry respectively a bending punch P and a corresponding matrix M.

The angle through which a metal sheet or lamination is bent depends on the extent to which the punch P penetrates into the matrix M, and consequently in order to obtain a bend of constant angle over the entire length of the bend it is necessary for said penetration to be the same over all of said length.

Figure 1:
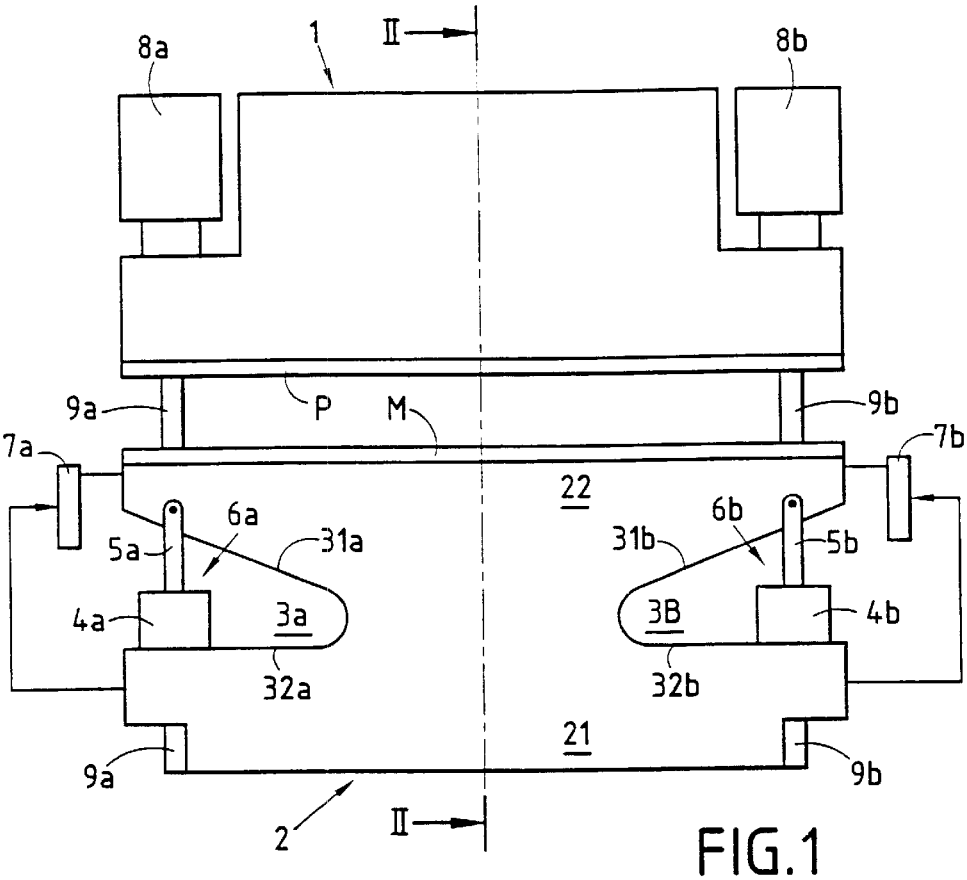
FIG. 1 is a diagrammatic view of a bending press of the invention with its displacement members.

The bottom panel 2 is constituted by a plate having two notches 3*a* and 3*b* that are symmetrically identical about a transverse midplane of the bottom panel as represented in FIG. 1 by section line II—II.

Each notch 3*a* and 3*b* has a respective top wall 31*a* or 31*b*, and a respective bottom wall 32*a* or 32*b* extending transversely relative to the plate that forms the bottom panel 2.

Each notch also has a back wall interconnecting the corresponding top and bottom walls 31*a* & 32*a* or 31*b* & 32*b* in a central zone of the bottom panel, together with an opening that is situated at the corresponding side edge of said bottom panel 2.

The top walls 31*a* and 31*b* slope at a certain angle relative to the bottom walls 32*a* and 32*b* that extend horizontally. This angle can naturally vary depending on the displacement member fitted to said notches or depending on the bending press range that is used.

Thus, the bottom panel 2 has a top portion 22 and a bottom portion 21 situated respectively above and below the two notches 3*a* and 3*b*.

Figure 2:
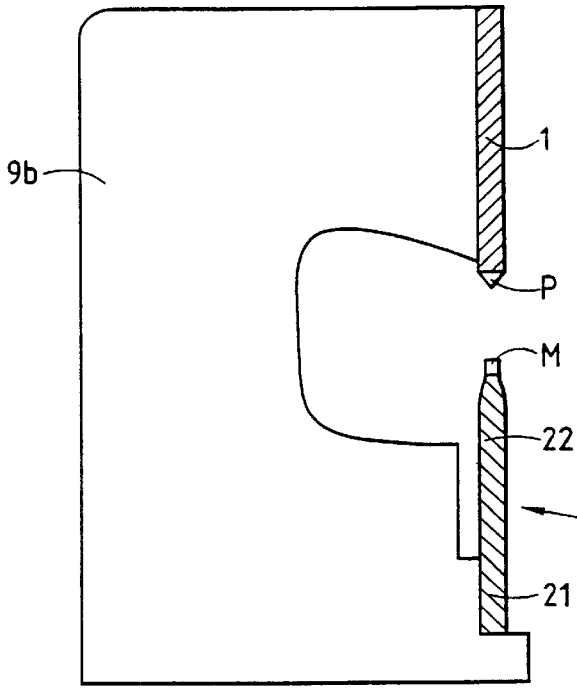
FIG. 2 is a vertical section view on line II—II of FIG. 1.

As can be seen in FIG. 2, the bottom portion 21 of the bottom panel 2 is fixed at its ends to the end plates 9*a* and 9*b* forming the frame of the bending press.

The bottom portion 21 can be fixed by welding or by any other means.

The top portion 22 of the bottom panel 2 is connected to the bottom portion 21 solely by means of the central zone situated between the two back walls of said notches 3*a* and 3*b*.

Thus, the top portion 22 of the bottom panel 2 possesses a degree of freedom in the vertical plane whereby its free ends can be moved relative to the fixed ends of the bottom portion 21.

In the present invention, each notch 3*a* and 3*b* is fitted with a respective displacement member 6*a* or 6*b* connecting the top portion 22 to the bottom portion 21 of the bottom panel 2.

Figure 3:
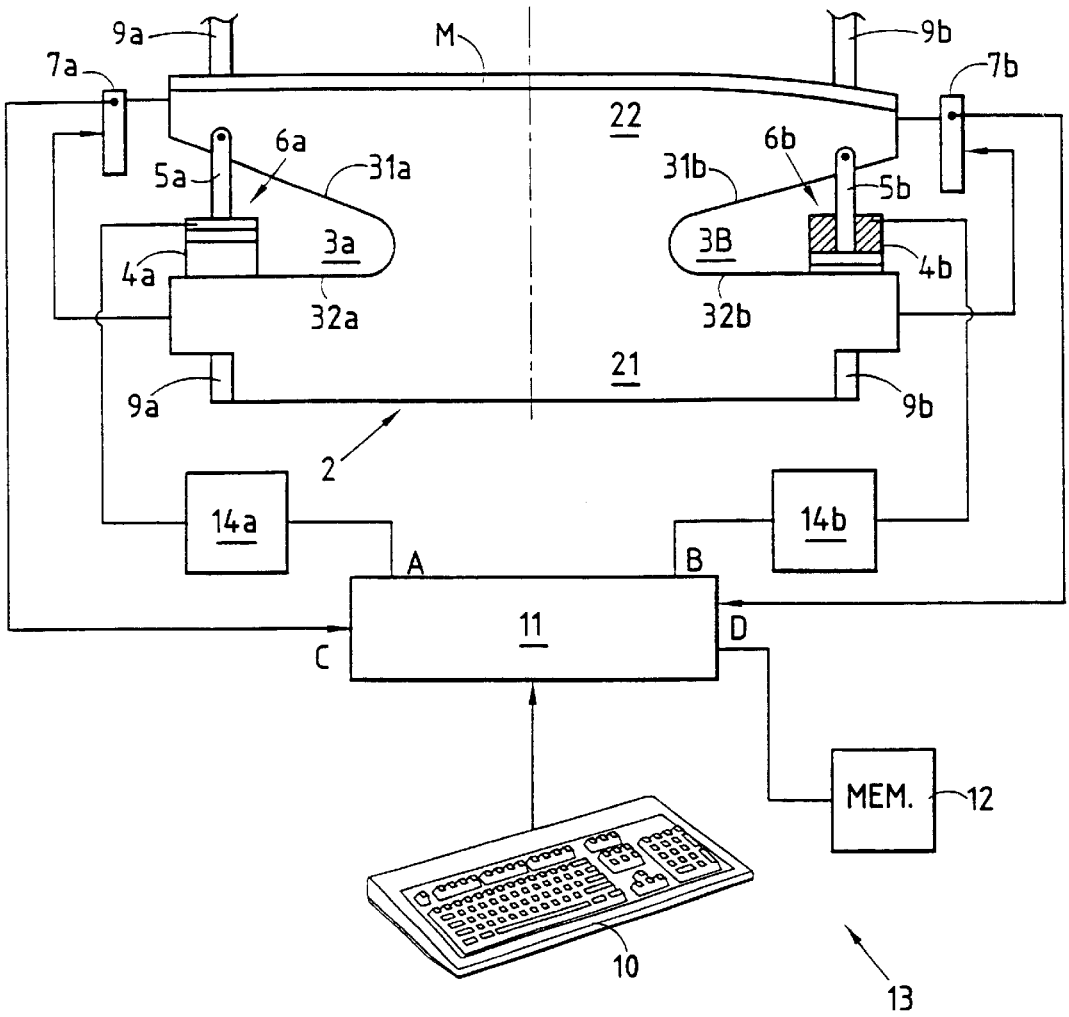
FIG. 3 is a block diagram showing a control unit for controlling the displacement members.

In the embodiment shown in FIGS. 1 and 3, the displacement members 6*a* and 6*b* are constituted by hydraulic actuators.

Each hydraulic actuator 6*a* and 6*b* comprises a respective cylinder 4*a* or 4*b* fixed to the bottom wall 32*a* or 32*b* of the corresponding notch and a respective piston rod 5*a* or 5*b* connected to the top wall 31*a* or 31*b* by a screw connection or any other means.

These hydraulic actuators 6*a* and 6*b* are located close to the openings of the notches so as to enable the free ends of the top walls 31*a* and 31*b* of said notches 3*a* and 3*b* to be moved accurately, as described in detail below.

These hydraulic actuators operate in retraction, thereby enabling the top walls 31*a* and 31*b* to be moved closer to the corresponding bottom walls 32*a* and 32*b*, thereby modifying the deformation curve of the free top portion 22 of said bottom panel 2 in a controlled manner prior to performing any bending operation, i.e. before moving the top panel 1 vertically.

With reference now to FIG. 3, a control unit 13 is described for controlling the stroke of each piston rod 5*a* and 5*b* of the hydraulic actuators 6*a* and 6*b* independently as a function of the curve which is to be given to each of the ends of the top portion 22 of the bottom panel 2.

The control unit 13 enables an operator to input the desired deformation curve for each of the halves of the free top portion of the bottom panel 2, with these two halves being defined about the transverse midplane of said bottom panel 2.

The control unit 13 comprises a processor unit 11 constituted by a microprocessor, for example. It also comprises a keyboard 10 enabling the processor unit 11 to receive the parameters of the deformation curve to be applied to each half of the top portion 22 of the bottom panel 2.

The keyboard 10 can be replaced by any other data acquisition means. The processor unit 11 is coupled to a program memory 12. The memory 12 contains in particular correspondence tables between the parameters of each deformation curve that can be implemented and the corresponding displacement that must be applied to the piston rods 5*a* and 5*b* of the hydraulic actuators 6*a* and 6*b*.

The operator also uses the keyboard 10 to enter data into the control unit concerning the nature of the sheet metal to be bent, its thickness, its length, and also the characteristics of the bend to be obtained (bend angle, tooling dimensions, . . . ).

By means of these tables and the data input by the operator, the processor unit 11 is capable of delivering displacement commands to each actuator 6*a* and 6*b* so that it moves the corresponding top walls 31*a* and 31*b* towards the bottom walls 32*a* and 32*b* respectively of the notches so that the deformation curve of the top portion 22 of the bottom panel 2 is accurately parallel to the deformation curve of the top panel 1 during the sheet metal bending stage. It should also be observed that the actuators 6*a* and 6*b* are locked in position during the stage in which said sheet metal is being bent.

To enable the processor unit to issue displacement commands to the actuators 6*a* and 6*b*, the inputs A and B of the processor unit 11 can be connected to two servo-control valves 14*a* and 14*b* that are powered by pumps (not shown). These valves 14*a* and 14*b* receive control signals from the processor unit 11 and feed the actuators 6*a* and 6*b* directly.

Thus, the control unit 13 serves to control each of the actuators 6*a* and 6*b* independently, thereby making it possible to implement eccentric bends on a metal sheet that is perhaps placed on only one of the two halves of the bottom panel 2, or else to implement bends that are centered over the entire length of the bottom panel 2, in which case the actuators 6*a* and 6*b* receive the same displacement instructions.

Furthermore, the control unit 13 has measuring means 7*a* and 7*b* placed in the openings of the two notches 3*a* and 3*b*. These measuring means serve to measure the distance between the free end of the top portion 22 from the fixed end of the bottom portion 21 of the bottom panel 2 so as to monitor the deformation curve of the bottom panel 2.

The measurements taken by the measurement means 7*a* and 7*b* are received by the processor unit via inputs C and D. These measurements of the deformation curve of each half of the bottom panel 2 are compared with the curves initially input into the processor unit.

When the deformation curves picked up by the measurement means 7*a* and 7*b* do not comply with the programmed curves, the processor unit delivers error-correction instructions to the actuators 6*a* and 6*b*.

Naturally, the processor unit 11 could also be coupled to other measurement means in the form of force sensors that continuously measure the bending force actually applied and its distribution relative to the plane of symmetry of the press, and position sensors that continuously measure the relative positions of the ends of the top and bottom panels 1 and 2.

Furthermore, if the bottom and top panels cease to be parallel while bending the sheet metal, it is clear that the control unit can deliver error-correction instructions on a continuous basis to the displacement members 6*a* and 6*b*.

Naturally, the invention is not limited in any way to the embodiment described and shown which is given purely by way of example. In particular, the displacement members 6*a* and 6*b* can be driven manually or electrically or by any other means that is technically equivalent.

Similarly, the top and bottom walls of each notch can be parallel to each other in which case it can be advantageous to place the fixed portion of the displacement member in a recess formed in the bottom wall of each notch.

What is claimed is:

1. A bending press for bending metal sheets, comprising a fixed bottom panel having two side edges, a vertical transverse midplane, and a free top portion having two ends, said bottom panel being provided with two notches, said two notches being disposed symmetrically with respect to said vertical transverse midplane; each notch having a top wall, a bottom wall and a back wall for interconnecting said top and bottom walls and an opening disposed within one of said side edges, said two notches defining within said bottom panel a lower fixed bottom panel portion disposed below said notches and upper deformable bottom panel portions disposed above said notches;

a movable top panel disposed above said bottom panel;

drive members disposed close to side edges of said bottom panel for moving said top panel in a vertical plane, said free top portion of the bottom panel having a deformation curve under the action of said movable top panel; and two displacement members, each displacement member being disposed within one of said notches, each one of said displacement members interconnecting said top wall and said bottom wall of one of said two notches and being adapted to move said top wall of said notch towards said bottom wall of said notch, whereby said deformation curve of said free top portion of said bottom panel is modified in a controlled manner.

2. The bending press according to claim 1, each displacement member comprising a fixed portion connected to the bottom wall of the notch and a moving portion secured to the top wall of the notch.

3. The bending press according to claim 2, further comprising a control unit for independently controlling each displacement member as a function of the curve to be given to each of said two ends of the free top portion of the bottom panel.

4. The bending press according to claim 1, wherein each displacement member is situated in the opening of a respective notch, so as to enable free ends of the top walls of said notches to be moved accurately.

5. The bending press according to claim 4, further comprising a control unit for independently controlling each displacement member as a function of the curve to be given to each of said two ends of the free top portion of the bottom panel.

6. The bending press according to claim 1, including a control unit for independently controlling each displacement member as a function of the curve to be given to each of said two ends of the free top portion of the bottom panel.

7. The bending press according to claim 6, the control unit comprising:

an information receiver that receives curve information concerning the curve to be given to the free top portion of the bottom panel; and an information converter that converts said curve information into control information for the displacement members.

8. The bending press according to claim 1, wherein the deformation curve of the free top portion of the bottom panel is modified independent of a movement of the movable top panel.

9. A bending press for bending metal sheets, comprising a fixed bottom panel having two side edges, a vertical transverse midplane, and a free top portion, said bottom panel being provided with two notches, said two notches being disposed symmetrically with respect to said vertical transverse midplane; each notch having a top wall, a bottom wall and a back wall for interconnecting said top and bottom walls and an opening disposed within one said side edges, said two notches defining within said bottom panel a lower fixed bottom panel portion disposed below said notches and upper deformable bottom panel portions disposed above said notches;

a movable top panel disposed above said bottom panel;

drive members disposed close to side edges of said bottom panel for moving said top panel in a vertical plane, said free top portion of the bottom panel having a deformation curve under the action of said movable top panel; and two displacement members, each displacement member being disposed within one of said notches, each one of said displacement members comprising a fixed portion connected to said bottom wall of the notch and a moving portion secured to said top wall of the notch, to move said top wall of said notch towards said bottom wall of said notch, whereby said deformation curve of said free top portion of said bottom panel is modified in a controlled manner.

10. The bending press according to claim 9, including a control unit for independently controlling each displacement member as a function of the curve to be given to each of said two ends of the free top portion of the bottom panel.

11. The bending press according to claim 10, the control unit comprising:

an information receiver that receives curve information concerning the curve to be given to the free top portion of the bottom panel; and an information converter that converts said curve information into control information for the displacement members.

12. The bending press according to claim 11, wherein the control unit further comprises a measurement system that obtains information about the actual curve of the free top portion of the bottom panel.

13. The bending press according to claim 11, wherein the control unit further comprises a measurement system that obtains information about the actual curve of the free top portion of the bottom panel, and the programmed curve.

14. A bending press for bending metal sheets, comprising a fixed bottom panel having two side edges, a vertical transverse midplane, and a free top portion, said bottom panel being provided with two notches, said two notches being disposed symmetrically with respect to said vertical transverse midplane, each notch having a top wall, a bottom wall and a back wall for interconnecting said top and bottom walls and an opening disposed within one of said side edges, said two notches defining within said bottom panel a lower fixed bottom panel portion disposed below said notches and upper deformable bottom panel portions disposed above said notches;

a movable top panel disposed above said bottom panel;

drive members disposed close to side edges of said bottom panel for moving said top panel in a vertical plane, said free top portion of the bottom panel having a deformation curve under the action of said movable top panel; and two displacement members, each displacement member being disposed within one of said notches, each one of said displacement members being disposed in said opening of said notch and interconnecting said top wall and said bottom wall of one of said two notches and being adapted to move said top wall of said notch towards said bottom wall of said notch, whereby said deformation curve of said free top portion of said bottom panel is modified in a controlled manner.

15. The bending press according to claim 14, including a control unit for independently controlling each displacement member as a function of the curve to be given to each of said two ends of the free top portion of the bottom panel.

16. A bending press for bending metal sheets, comprising a fixed bottom panel having two side edges, a vertical transverse midplane, and a free top portion, said bottom panel being provided with two notches, said two notches being disposed symmetrically with respect to said vertical transverse midplane; each notch having a top wall, a bottom wall and a back wall for interconnecting said top and bottom walls and an opening disposed within one of said side edges, said two notches defining within said bottom panel a lower fixed bottom panel portion disposed below said notches and upper deformable bottom panel portions disposed above said notches;

a movable top panel disposed above said bottom panel;

drive members disposed close to side edges of said bottom panel for moving said top panel in a vertical plane, said free top portion of the bottom panel having a deformation curve under the action of said movable top panel;

two displacement members, each displacement member being disposed within one of said notches, each one of said displacement members being disposed in said opening of said notch and interconnecting said top wall and said bottom wall of one of said two notches and being adapted to move said top wall of said notch towards said bottom wall of said notch; and a control unit for independently controlling each one of said displacement members as a function of the deformation curve to be given to each end of said free top portion of said bottom panel.

* * * * *